United States Patent [19]

Walsh et al.

[11] 3,973,065

[45] Aug. 3, 1976

[54] SYNTHETIC SUEDE

[75] Inventors: David I. Walsh, Barrnington, R.I.; James P. Casey, Seekonk, Mass.

[73] Assignee: Microfibres, Inc., Pawtucket, R.I.

[22] Filed: Jan. 10, 1975

[21] Appl. No.: 540,280

Related U.S. Application Data

[63] Continuation of Ser. No. 403,605, Oct. 4, 1973, abandoned.

[52] U.S. Cl. ..... 428/89; 28/75 R; 28/76 R; 428/90; 428/96; 428/151; 428/904; 28/75 WT; 28/76 P

[51] Int. Cl.[2] ..... B05D 1/14; B05D 1/16; B32B 33/00

[58] Field of Search ..... 428/90, 96, 151, 904, 428/88, 89; 8/94.13, 130.1; 28/75, 76; 252/8.8

[56] References Cited

UNITED STATES PATENTS

| | | | |
|---|---|---|---|
| 3,114,191 | 12/1963 | Chapin | 8/130.1 |
| 3,343,980 | 9/1967 | Hirshfeld | 252/8.8 |
| 3,356,521 | 12/1967 | Boltniew | 252/8.8 |
| 3,498,816 | 3/1970 | Finch | 252/8.8 |
| 3,632,396 | 1/1972 | Zamora | 252/8.8 |
| 3,652,329 | 3/1972 | Vossos | 252/8.8 |
| 3,664,952 | 5/1972 | Maske | 252/8.8 |
| 3,681,241 | 8/1972 | Rudy | 252/8.8 |
| 3,703,480 | 11/1972 | Grand | 252/8.8 |
| 3,776,753 | 12/1973 | Habib | 428/90 |

*Primary Examiner*—Marion E. McCamish

[57] ABSTRACT

A synthetic suede is disclosed comprising a flexible backing having a multiplicity of upstanding flock fibers adhered to the base, and a fatty acid radical cationic softener substantially uniformly distributed over at least portions of the fibers at or near their ends. Typical cationic softeners include the fatty acid quaternary ammonium softeners.

20 Claims, 6 Drawing Figures

SYNTHETIC SUEDE

RELATED APPLICATION

This is a continuation of U.S. application Ser. No. 403,605, filed Oct. 4, 1973, now abandoned.

BRIEF DESCRIPTION OF THE INVENTION

This invention relates to a synthetic suede material having a smooth, suede-like hand. The invention further relates to synthetic suede which adapts itself readily to the formation of patterns on the suede surface as by dyeing, crushing, clumping and shading, for example. Suede, in accordance with this invention, is adaptable to a wide variety of uses, particularly by taking advantage of dramatic effects that are achieved by making small changes in the denier in the flocked fibres and by varying their length and the specific nature of their surface treatment. Preferably, in accordance with this invention, at least portions of the flocked fibres in the area of their ends are treated with a cationic softener containing an organic acid radical.

BACKGROUND OF THE INVENTION

It has been known heretofore to provide a flocked fabric by passing a base fabric with an adhesive coating through an electrostatic flocking machine in which the electrostatic field that is generated within a chamber causes the fibres to adhere essentially vertically on the surface of the fabric. The adhesive, usually latex, has already been applied to at least one surface of the fabric, and the ends of the flocked fibres embed themselves in the latex and are anchored there when the latex is subsequently dried or cured. Such fabrics have had utility for a wide variety of purposes but have had the serious limitation that they possess a rather disagreeable "hand" or surface feel or appearance which has seriously limited the saleability of the product.

Similarly, efforts have been made to create synthetic suede having surface patterns according to a predetermined geometric design and to use different colors or different tones of a color, but the resulting products have been deficient in appearance and have been subject to serious damage when washed or exposed to water.

OBJECTS OF THE INVENTION

It is, accordingly, an object of the invention to overcome the foregoing disadvantages and to provide a dyed and finished suede which has an excellent "hand", which lends itself to a variety of interesting suface treatments, and which may be subjected to the action of water or even washed repeatedly or dry cleaned without seriously adversely affecting the aforementioned properties.

The foregoing and other objects of this invention, including the simplicity and economy of the same, and its adaptability to a wide variety of fields of use, will become more clearly apparent hereinafter, and in the drawings.

DRAWINGS

DETAILED DESCRIPTION OF THE INVENTION

In accordance with this invention a synthetic suede is provided which comprises a fabric having a multiplicity of flocked fibres adhered to and extending essentially upright from the fabric surface. According to this invention a majority of the fibres have a denier of about ½ to 5, but in certain preferred forms the denier may be 1 to 4. In many cases the highly preferred deniers are 1 and 3.

According to this invention a cationic softener is applied over at least the free end portions of the flocked fibres. This cationic softener contains a fatty acid radical and is usually a quaternary ammonium compound.

Preferably, the softener is present in an amount of about 35 to 65% by weight based upon the weight of the fibres.

In accordance with a particularly preferred embodiment of this invention wherein it is desired to obtain a surface effect remarkably resembling that of natural pigskin, the denier of the flocked fibres must be critically regulated to about 3 denier, which expression may include deniers of 2 and 4 but not 1 and 5. It has been discovered that when the denier, particularly that of a rayon flocked fibre, is controlled to about 3 denier and the length of the fibres is about 0.010 to 0.040 inch, a remarkable wicking effect takes place upon drying after the fatty acid quaternary ammonium softener has been applied. This wicking effect tends to cause a plurality of flocked fibres to adhere to each other in the neighborhood of their free ends, thus giving the finished synthetic suede product the strikingly attractive appearance of high quality natural pigskin.

Figure 1:
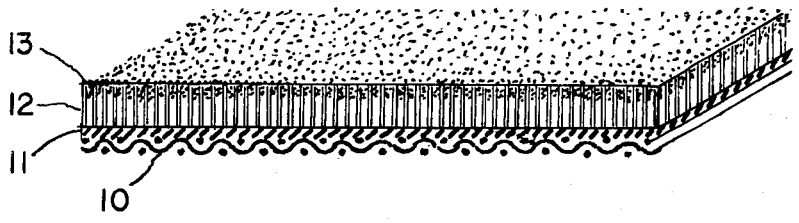
FIG. 1 is a view in perspective of a flocked synthetic suede embodying certain features of this invention.

FIG. 1 of the drawings shows the fabric 10 having a surface coating of adhesive 11 to which the flocked fibres 12 are secured. The number 13 designates a layer of the chemical additive such as quaternary ammonium fatty acid compound. In FIG. 1 the denier and length of the fibres and the manner of preparation of the product have been controlled in such a manner as to avoid wicking and to produce a smooth, uniform synthetic suede surface. Although the softener as shown is applied to only a portion of the length of each flocked fibre, it is often preferred to coat the entire length.

Figure 2:
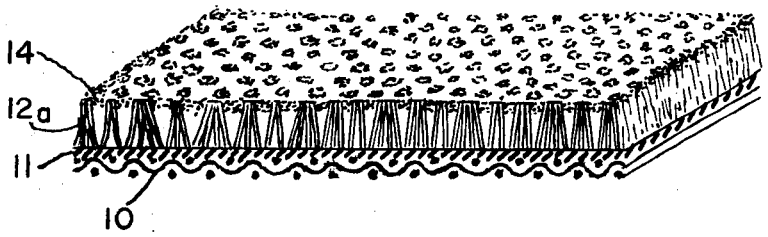
FIG. 2 is a view similar to FIG. 1 showing a modified form of synthetic suede according to the invention.

In FIG. 2, the flocks 12 are shown in grouped relationship where several free ends (as indicated at **12*a*) are adhered together and are so maintained by the presence of the quaternary ammonium fatty acid compound. The number 14** designates the various points where the fibres have wicked together to provide an appearance strongly resembling that of pigskin.

In accordance with certain embodiments of the invention, the length of the fibres should be carefully controlled. Although the preferred length falls within the range of about 0.005 to 0.075 inch, in certain highly preferred embodiments the length of the fibres is about 0.010 to 0.040 inch.

Although it is not necessary in all cases that the lengths of the fibres be substantially identical to one another, this is highly preferred and for that reason, some high quality synthetic suede in accordance with this invention is composed of "precision cut" fibres wherein substantially all of the fibres are of the same length, plus or minus 10%.

In accordance with this invention various other surface treatments, in addition to the treatment with the softeners, may be used, For example, the cut fibres or the flocked fibres may be dyed, usually the fatty acid softener has been applied. However, special effects are obtained by treating part of the flocked fibres with softener and then dyeing; the softener selectively impedes the dye affinity of the fibres and produces an unusual multi-colored dyed effect. In other forms of the invention, portions of the fibres may be selectively crushed in the form of a predetermined pattern after which the fatty acid softener is applied to the surface that remains exposed, thus providing artistic and interesting crushed suede designs. Further, the suede may be specially treated by either using different colors, different combinations of colors or different shades of the same color in accordance with predetermined patterns either independently or in combination with the selective crushing operation previously referred to.

The softeners comprising essential ingredients of the synthetic suede according to this invention, are preferably quaternary ammonium salts of long chain aliphatic fatty acids having from about 12 to 18 carbon atoms, usually 16 or 18 carbon atoms.

Typical members of the group include: cetyl trimethyl ammonium chloride, dodecyl trimethyl ammonium bromide, ditallow dimethyl ammonium chloride and sulphate, -2-heptadecyl-1-methyl-1-(2-stearyl amido ethyl) imidazoline chloride and sulphate, dimethyl benzyl ammonium chloride, cetyl pyridinum chloride or bromide, cetyldimethylbenzylammonium chloride and diethyloctylstearylammonium chloride, dimethyldistearylammonium chloride, tallow-dimethyldihydrogeno quaternary ammonium chloride, di(hydrogenated tallow alkyl)-poly(oxyethylene-oxypropylene) (methyl)ammonium chloride, di(hydrogenated tallow alkyl) poly(oxyethylene-oxypropylene) (ethyl-)ammonium bromide, bis-(alkoxypropyl)dimethylammonium chloride, dimethylbis(phenylstearyl)ammonium chloride, dimethyl-(hydrogenated tallow) ($C_{11-15}$-sec-alkyl) ammonium chloride, dimethyl(hydrogenated-tallow)ammonium chloride, bis(2-hydroxyethyl) (phenylstearyl) ammonium chloride, bis(2-hydroxyethyl) (mixed hydrogenated-tallow) ($C_{11-15}$-sec-alkyl)ammonium chloride 50, dimethylbis (hydrogenated-tallo)ammonium chloride, 3,6-dioxa-1,8-octamethylene-bis[(nonadecanoyloxymethyl)dimethylammonium chloride], 1-methyl-1-[β-(stearoylamino)ethyl]-2-heptadecylimidazolium chloride, 2-oleyl-1-alkylimidazolium acetates, bis(2-hydroxyethyl)dialkylammonium chlorides, trimethylphenyloctadecylammonium chloride, (3-phenyl-1,2,4-oxadiazolyl-5-methyl)-lauryldimethylammonium chloride, (3-hard tallow-1,2,4-oxadiazolyl-5-methyl) (2-hydroxyl-$C_{16-18}$-alkyl)dimethylammonium chloride, (3-coco-1,2,4-oxadiazolyl-5-methyl) (2-hydroxyl-$C_{16-18}$ alkyl)dimethylammonium chloride, disteryldimethylammonium chloride, (β-carbamoyl-β-hydroxyethyl) alkylammonium salts, ditallow dimethylammonium chloride, ditallow dimethylammonium methosulfate, 1-methyl-1-stearoylamidoethyl-2-heptadecylimidazolinium methyl sulfate, or bis(2-tallowimidoethyl)methyl 2-hydroxyethylammonium methyl sulfate, dimethyldistearylammonium chloride, dilauryl poly(oxyethylene)tertiary amine, dimethyldistearylammonium methosulfate, trimethylstearylammonium chloride and dicoco poly(oxyethylene) tertiary amine.

Many of the commercial materials are complex mixtures rather than single compounds; some of the most important ones are given below.

a. Reaction products of fatty acids or acid chlorides with amino alcohols

Depending on reaction conditions two classes of softeners are obtained from this reaction; this is illustrated below with a fatty acid and hydroxyethyl ethylene diamine:

i. Amino esters $$RCOOH + H_2N.CH_2CH_2NH.CH_2CH_2OH \rightarrow RCOO.CH_2CH_2NHCH_2CH_2NH_2$$

These esters typified by the "Soromines" or "Emulphors" (General Aniline) are, as expected, fairly readily hydrolysed. The quaternaries derived from these are also easily hydrolysed.

ii. Cationic amides $$RCOOH + H_2N.CH_2CH_2NH.CH_2CH_2OH \longrightarrow HN(COR).CH_2CH_2N(COR).CH_2CH_2OH$$

These softeners are typified by the "Ceranines" (Sandoz) — a typical example is NN′ distearoyl N′ ethanol ethylene diamine.

b. Reaction products of fatty acids with short chain polyamines i. Amino amines

These are formed by the reaction of a fatty acid or glyceride with a substituted or unsubstituted short chain polyamine. Reaction generally occurs with only one of the amine functions, converting it to an amide, leaving one or more unreacted amine groups:

$$R.COOH + H_2N.CH_2CH_2N(C_2H_5)_2 \longrightarrow RCONH.CH_2CH_2N(C_2H_5)_2 + H_2O$$

These as their acetates and hydrochlorides constitute one of the largest groups of cationic textile softeners, and are claimed to be especially effective on chlorinated wool. They are not of any great importance as softeners for the household products. Further alkylation with dimethyl sulphate gives the quaternary softeners — these are marketed by CIBA under the trade name 'Sapamines'.

c. Reaction products of amines with alkylating agents

Reaction of amines with alkylating agents such as methyl chloride, benzyl chloride, dimethyl sulphate gives quaternary softeners, e.g. octadecyl dimethyl benzyl ammonium chloride is prepared as follows:

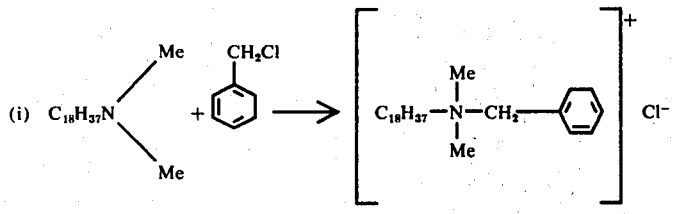

ii. One of the most important softeners for the household product is dihardened tallow dimethyl ammonium chloride which is prepared as follows:

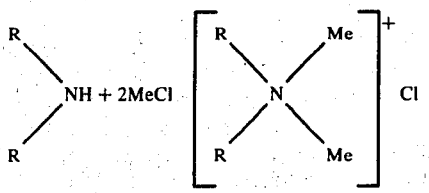

where R is the hardened tallow chain. This is marketed by Armour under the trade name 'Arquad 2HT'.

d. Reaction products of fatty acids with e.g. ethylene traimine

Another important class of softeners are the imidazolines (or glyoxyalidines) derived from fatty acids and certain amines, e.g. ethylene triamine. Amido amines are formed first and on raising the temperature they lose water and cyclize to a ring structure as follows:

A typical softener used in some household products is 2 heptadecyl-1-methyl-1 (stearoyl amido ethyl) imidazoline methosulphate.

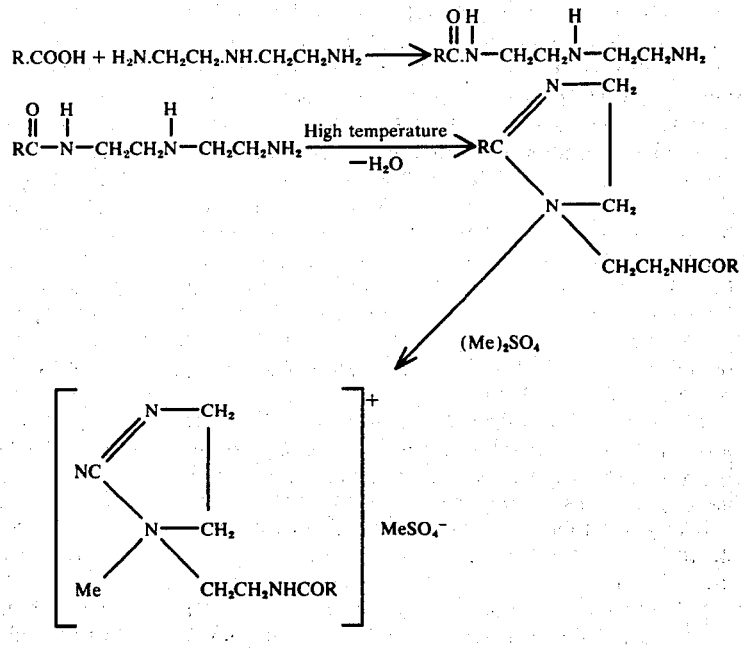

Preferred forms of cationic softeners, in accordance with this invention, include "Ceranine PNS" (Sandoz) which is a quaternary amine softener of which a typical example is NN' distearoyl N' ethanol ethylene diamine. Another preferred form of cationic softener is "Ibersoft A-50" (A. Harrison) which is also a quaternary amine compound of an aliphatic long chain fatty acid. Mixtures of several such quaternary amminium compounds may be used, as will be apparent.

It is important, in accordance with this invention, that the softener by a cationic softener. The non-ionics and the anionics have been found not to function properly in accordance with this invention, and have failed to produce the slightly slippery or greasy, leather-like hand of fine quality, natural suede.

Although it has previously been suggested in the prior art to apply a cationic softener of a fatty acid organic compound to a fabric, such an application has been for the purpose of giving the fabric a so-called "permanent press" characteristic. When creating a "permanent press" fabric, relatively small amounts of the cationic softeners are used, such as about ½ to 2 ounces of softener per square yard.

In contrast, in accordance with this invention the amounts of softener are so high as to be virtually unheard of; it is highly preferred to provide about 35% to 65% by weight of cationic softener, based upon the weight of the fibres. To my knowledge, such a quantity would be considered grossly excessive by those who are skilled in the art, nor would it ordinarily occur to anyone who is interested in permanent press characteristics to apply such a grossly excessive quantity when the rather minimal quantities heretofore used have been found to contribute perfectly adequate permanent press characteristics. So far as I am aware, the standard quantity previously used for permanent press applications have been at most from about 3 to 10% by weight, based upon the weight of the fabric.

In accordance with this invention, various types of fibres may be used including rayon, nylon, polypropylene, polyethylene, polyethyleneterephthalate, for example. Various other synthetic and natural fibres may be used. However, for the purpose of the present invention nylon and the acrylics do not provide optimum surface characteristics, and rayon is by far the best, lends itself to crushing, and is highly preferred in accordance with this invention.

The fibres may be cut to any length within the range of about 0.005 to 0.075 inch, and their length should preferably be approximately 0.010 to 0.040 inch. As stated, best results are obtained with precision cut, flocked fibres wherein substantially all fibres are of the same length, plus or minus 10%.

In the method of producing the synthetic suede according to this invention, a standard electrostatic flocking chamber may be used. The base material may be any desired fabric, and it is passed continuously through an electrostatic flocking chamber first having had a surface adhesive applied to at least one of its surfaces. The flocked fibers are continuously fed in known manner into the chamber, and the electrostatic field causes them to stand vertically on the fabric surface with their bases embedded in the adhesive. The adhesive is caused to dry and cure with the flocked fibres in place and, if the fibres have not been previously dyed, then the fabric is optionally run through a dye bath in a conventional manner in order to apply the desired color to the fibres and to the base fabric.

Figure 5:
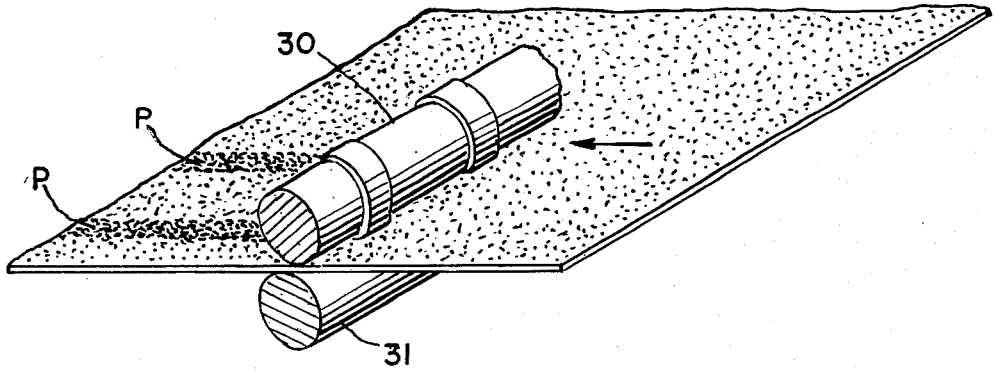
FIG. 5 is a view in perspective of another embodiment.
Figure 6:
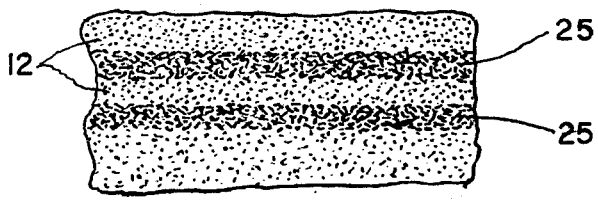
FIG. 6 is a plan view of a typical form of synthetic suede produced by the embodiment of FIG. 5.

While wet, the fabric is passed (usually in an upright position with the fibres facing upwardly from the fabric surface) through an aqueous solution of the selected fatty acid quaternary ammonium softener, or against the surface of a roll which applies the softener. The usual object is to cover all the flocked fibres completely with the softener, which usually does not penetrate through the adhesive to the substrate. After emerging from the softener solution, the flocked fabric may either be conducted through a dryer to produce the final product or may be crushed as shown in FIG. 5 between an engraved roll 30 and a plain roll 31, the former embossed with a pattern P simulating any selected form of natural leather. One such form having random streaks 25 and crushed flock 12, appears in FIG. 6.

Figure 3:
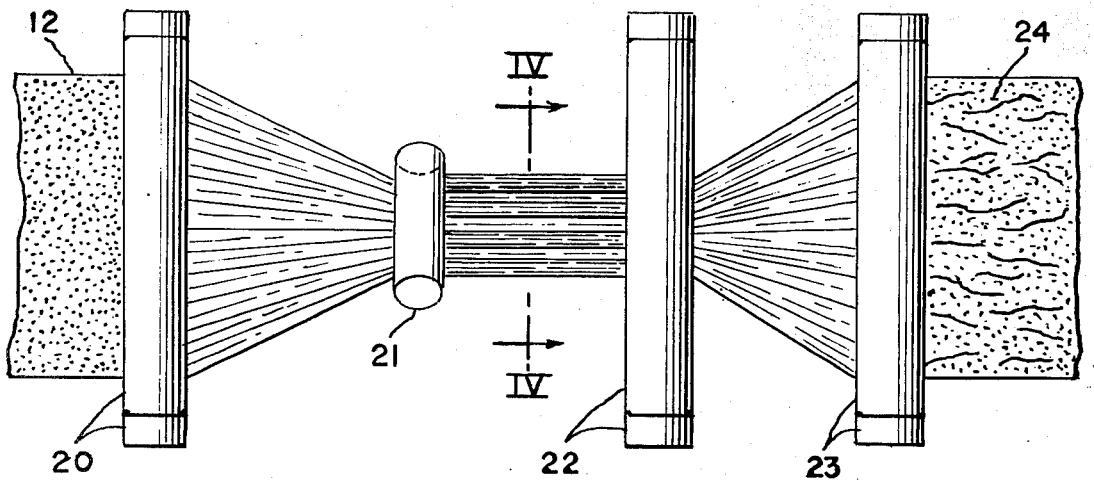
FIG. 3 is a top view, looking downwardly, showing an apparatus and method for making a modified form of flocked synthetic suede according to this invention.
Figure 4:
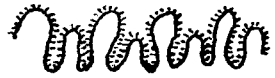
FIG. 4 is a sectional view taken as indicated by the lines and arrows IV—IV which appear in FIG. 3.

On the other hand, the flocked fabric may be passed through a pot eye as shown in FIGS. 3 and 4 of the drawings, to produce a random pattern.

In FIG. 3, the number 20 designates the top roll of a pair of similar feed rolls which are feeding a flocked fabric like that of FIG. 1, with the flocked fibres 12 facing upwardly. Usually the flocked fabric is wet, often as a result of dyeing in a hot dye bath, but usually (also) because of saturation of the flock with cationic softener solution or emulsion, ahead of rolls 20. The wet flocked fabric from feed rolls 20 is contracted through a restricted opening, as in a pot eye 21, and is then passed through a pair of pressure rolls 22 and expanded laterally to pass at full width through opening or delivery rolls 23. This produces a synthetic suede in which the flocked fibres are randomly crushed, by the rolls 22, forming an interesting and randomly changing crushed pattern 24.

A knife over-roll coater can be used instead of the upper roll 20. Coatings may be applied in other ways as well.

FIG. 4 shows the fabric bundled and curled upon itself under the influence of pot eye 21.

Such crushing may be applied to the suede either before or after the application of the fatty acid quaternary ammonium softener.

In connection with the denier of the flocked fibres, particularly when the material is rayon, a 1-denier flocked fibre produces a very smooth suede-like hand and this form of the invention lends itself most admirably to the use of a patterned embossing roll because the pattern of the roll can readily be seen as crinkles in conjunction with the fine fibres as they exist in the final product. As stated, 3-denier rayon in carefully controlled lengths produces a highly desirable, clumped effect having the general appearance of fine pigskin. Varying amounts of quaternary ammonium compounds produce varying colors and shades, whether applied before or after dyeing. They also contribute to pile and lay of the flock, and also contribute a delustering effect to the flock.

Synthetic suedes in accordance with this invention have significant advantage in that they are quite readily washable. In this connection, they differ drastically from high quality natural suede which is virtually ruined after the first washing. Even after repeated washings of the synthetic suede of this invention, the suede-like hand is retained quite well, although after quite a number of washings, some of the softness of the leather-like feel is gradually diminished.

Although further treatments of the synthetic suede of this invention are not entirely necessary, it is sometimes preferable to abrade the surface of the suede after drying. This is particularly true in the case of products that are intended to have a uniform surface appearance.

Various types of base fabrics may be used depending upon intended use, availability and economic factors. The base may be woven, non-woven, plastic or any other base material which will withstand treatment in the electrostatic flocking chamber, in the aqueous baths previously referred to herein, and in service.

Various tests have been run on synthetic suede products according to this invention. These have included tests on the Taber Abrader with this new product. The new product, having 1-denier rayon and 0.020 inch flock length, survives about 800 cycles on the Taber Abrader, using a CS-10 wheel and a 500 gram weight. By way of comparison, the two long-standing suede products in the market are cotton flocked suede and the 0.75 denier rayon flocked suede. The 0.75 denier rayon suede survives only about 150 cycles on the Taber Abrader with the same CS-10 wheel and the same 500 gram weight. The cotton flocked suedes which have been commercially available even longer than the 0.75 rayon, when tested on the Taber Abrader, survive about 250 cycles with the same CS-10 wheel and a 500 gram weight. Accordingly, the new product according to this invention is vastly superior in abrasion to the two most widely used available products.

In addition to the other desirable effects that are provided by the cationic softener, it also provides an optical dulling effect on the surface of the synthetic suede, providing a remarkable likeness to the dull surface appearance of high quality natural suede.

Although this invention has been shown and described in connection with specific embodiments thereof, it will be appreciated that variations may be made without departing from the spirit and scope of this invention. For example, various other quaternary ammonium fatty acid compounds may be substituted for those specifically disclosed, various combinations of microfibres and base fabrics may be used interchangeably and other changes may be made including the substituting of equivalents, all without departing from the spirit and scope of the invention as defined in the appended claims.

The following is claimed:

1. Synthetic suede having a leather-like hand comparable to natural suede comprising a flexible substrate having a multiplicity of upstanding flock fibres, adhesive means contacting said fibres and said substrate whereby said fibres are adhered to and extend upright from the substrate, a majority of said fibres having a denier of about ½ to 5, the lengths of said fibres being about 0.005 to 0.075 inch, said flock fibres being crushed in accordance with a predetermined pattern, and an organic acid radical cationic softener substantially uniformly distributed over at least the free end portions of said fibres, said softener being applied to the flock fibers in an amount to cause at least some of the free ends of said flock fibres to adhere at various points on the surface of the suede.

2. The synthetic suede defined in claim 1, wherein the denier of said fibres is 2 to 4.

3. The synthetic suede defined in claim 1, wherein the denier of said fibres is 3.

4. The synthetic suede defined in claim 1, wherein said fibres are rayon.

5. The synthetic suede defined in claim 1, wherein said softener is present in an amount of about 35–65% by weight, based upon the weight of the fibres.

6. The synthetic suede as defined in claim 1, wherein said softener is adhered to at least the end portions of said fibres and wherein said end portions are clumped together.

7. The synthetic suede defined in claim 1, wherein said length is about 0.010 to 0.040 inch.

8. The synthetic suede defined in claim 1, wherein said fibres are precision cut and substantially all of said fibres are the same length, plus or minus 10%.

9. The synthetic suede defined in claim 1, wherein said fibres are dyed.

10. The synthetic suede defined in claim 1, wherein the amount of said softener is such as to provide a slippery leather-like hand on the surface of said synthetic suede.

11. The synthetic suede defined in claim 1, wherein said fibres have a dyed pattern having different colors.

12. The synthetic suede defined in claim 1, wherein said softener is a quaternary ammonium salt of a long chain aliphatic fatty acid having from about 12 to 18 carbon atoms.

13. The synthetic suede defined in claim 1, wherein said softener is present in an amount of about 35–65% by weight, based upon the total weight of the fibres.

14. In a method of producing a synthetic suede having a leather-like hand comparable to natural suede, comprising the steps of coating a base fabric with adhesive, electrostatically flocking said coated fabric by adhering with the use of adhesive to said fabric a multiplicity of fibres extending essentially upright from the fabric surface, and drying said adhesive on said fabric, said fibres having a denier of about ½ to 5 and a length of about 0.005 to 0.075 inch, wherein the improvement comprises crushing said flock fibres in accordance with a predetermined pattern and, before or after said crushing, applying to at least the ends of said fibres a fatty acid radical cationic softener distributed substantially uniformly over said ends, said softener being applied to the flock fibers in an amount to cause at least some of the free ends of said flock fibres to adhere at various points on the surface of the suede.

15. The method defined in claim 14, including the step of applying said softener in an amount of about 35–65% by weight, based upon the total weight of the fibres.

16. The method defined in claim 14, wherein said fibres have a denier of 2 to 4, and said softener is in the form of an aqueous medium.

17. The method defined in claim 14, including the step of applying mechanical pressure to said synthetic suede in a wet condition, in a manner to cause said fibres to crinkle in the form of a pattern.

18. The method defined in claim 17, wherein said pattern is a predetermined pattern.

19. The method defined in claim 18, wherein said pattern is a random pattern.

20. The method defined in claim 14, including the further step of selectively crushing the fibres in the presence of said softener with different pressures to form said fibres into clumps.

* * * * *